United States Patent [19]
Pusch et al.
[11] 4,308,882
[45] Jan. 5, 1982

[54] TENTS FOR MILITARY USE AND PROVIDING PROTECTION AGAINST MODERN SIGHT AND IR-OPTICAL SEARCH METHODS

[76] Inventors: Günter Pusch, Bannholzweg 12, 6903 Neckargemund 2; Alexander Hoffmann, Heidelbergerstr. 24,, 6901-Mauer, both of Fed. Rep. of Germany

[21] Appl. No.: 44,010

[22] Filed: May 31, 1979

[51] Int. Cl.[3] ..... A45F 1/12; F41H 3/00

[52] U.S. Cl. ..... 135/1 R; 135/14 V; 428/919; 343/18 R

[58] Field of Search ..... 135/1 R, 5 R, 14 V, 135/35 V; 428/919; 343/18 R, 18 A

[56] References Cited

U.S. PATENT DOCUMENTS

| | | | |
|---|---|---|---|
| 2,349,993 | 5/1944 | Schwimmer et al. | 135/5 R |
| 2,840,500 | 6/1958 | Okoomian et al. | 343/18 A |
| 3,059,364 | 10/1962 | Landsberg et al. | 428/919 X |
| 3,427,619 | 2/1969 | Wesch et al. | 343/18 R |
| 3,598,133 | 8/1971 | Abert | 135/14 V X |
| 3,733,606 | 5/1973 | Johansson | 428/919 |
| 3,970,096 | 7/1976 | Nicolai | 135/14 V |
| 4,001,827 | 1/1977 | Wallin et al. | 428/919 X |
| 4,064,305 | 12/1977 | Wallin | 428/919 X |
| 4,142,015 | 2/1979 | Bienz | 428/919 |

FOREIGN PATENT DOCUMENTS

| | | | |
|---|---|---|---|
| 514110 | 9/1952 | Belgium | 135/14 V |
| 2252431 | 5/1974 | Fed. Rep. of Germany | 428/919 |
| 2738188 | 4/1978 | Fed. Rep. of Germany | 428/919 |
| 1404121 | 8/1975 | United Kingdom | 428/919 |

*Primary Examiner*—J. Karl Bell
*Attorney, Agent, or Firm*—Michael N. Meller

[57] ABSTRACT

Tents with one or more walls for military use that provide protection against modern sight and IR-optical search methods, in which plastic-coated metallized cloth is used as a material for the tent walls and roofs. The outer side of the outermost tent wall is provided with known camouflage paints. The inner side of the outer cloth layer as well as the outsides and insides of the inner cloth layers are provided with only one color that is practically impervious to the infrared portion of the spectrum of about 3 to 20 μm.

8 Claims, 6 Drawing Figures

FIG. 1a
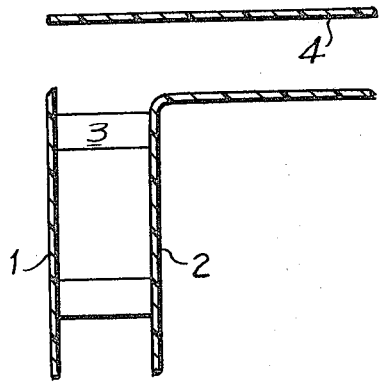
FIG. 1
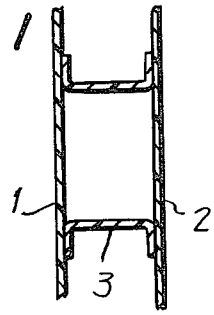
FIG. 2
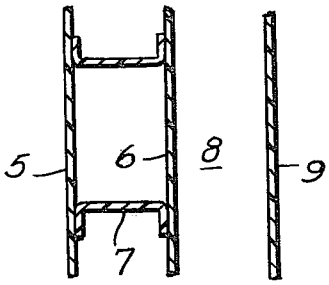
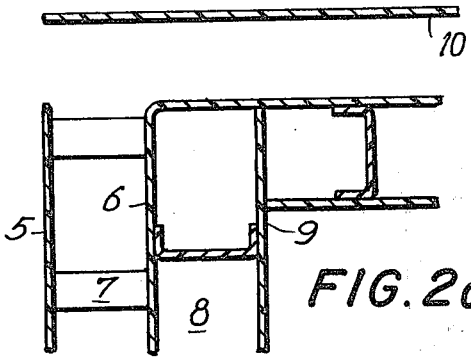
FIG. 2a
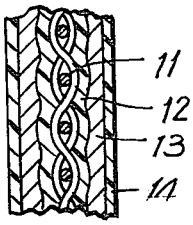
FIG. 3
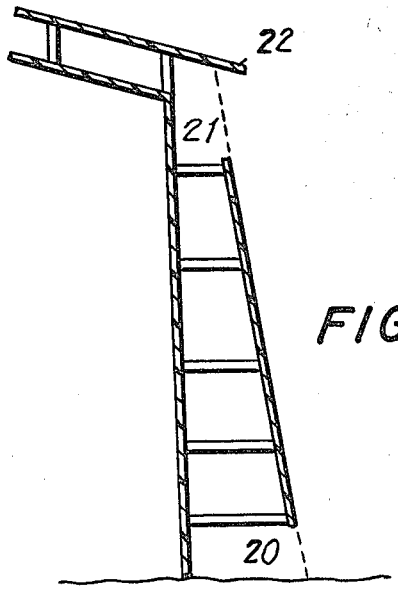
FIG. 4

TENTS FOR MILITARY USE AND PROVIDING PROTECTION AGAINST MODERN SIGHT AND IR-OPTICAL SEARCH METHODS

BACKGROUND OF THE INVENTION

The present tents for military use normally provide only limited protection against the weather. Above all, they are easily recognized at night, if they are lit up inside, by sight-optical search apparatus. The camouflage used until now on tents is not sufficient against modern IR-optical sensors, that work chiefly in the spectral range between 3 and 5 μm and in the spectral range of 8 to 12 μm wavelength, as the tent walls and ceilings are heated by the people inside or by appliances and their outlines. They are therefore recognizable at great distances by the abovementioned sensors.

Accordingly, an object of the present invention is to avoid these disadvantages of previous tents and to protect them from being located at night by sight as well as by distance IR-thermal search devices such as Infrared Fire Control or Linescan.

SUMMARY OF THE INVENTION

The object of the present invention is achieved as follows:

(a) Using plastic-coated metallized cloth as material for tent walls and ceilings. Using 2 or 3 layers of said cloth which are properly spaced by textile strips and or air pressure, to make up one wall or ceiling.

(b) The outside of the outermost tent wall is provided with the known camouflage paints; and (c) both the inner side of the outer cloth layer as well as the outsides and the insides of the inner cloth layers are not to be dyed or are to be provided with only one paint coat that is practically pervious to the infrared portion of the spectrum of about 3 to 20 μm wavelength.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 shows a top view in cross section of a portion of a tent wall having two layers in accordance with the present invention;

FIG. 1*a* shows a side view of the tent wall of FIG. 1;

FIG. 2 shows a top view in cross section of a tent wall having three layers;

FIG. 2*a* shows a side view of the tent wall in FIG. 2;

FIG. 3 shows the cross section of plastic coated metallized cloth;

FIG. 4 shows the cross section of the whole vertical wall, according to FIG. 1.

BRIEF DESCRIPTION OF THE PREFERRED EMBODIMENTS

The tent arrangement of the present invention has an outer cloth layer and one inner cloth layer as shown in FIGS. 1 and 1*a* or two inner cloth layers as shown in FIGS. 2 and 2*a*. All the cloth layers are made of plastic coated metallized fabric as shown cross-sectionally in FIG. 3. There exists a variety of possible fabrics for this purpose which differ in mechanical and chemical quality but are all suitable (see FIG. 3):

(a) lightwoven fabric 11 for example, of polyamide, polyester, or glass fiber. 20 gr/m$^2$ to 400 gr/m$^2$;

(b) Plastic coating 12 for example of soft PVC, polyurethane, or silicone rubber with or without flammability-decreasing additives such as antimony trioxide. 20–400 gr/m$^2$;

(c) metal film 13 of aluminum, tin or CrNi, 20–50 nm thick. Made by vacuum vapor deposition onto a transfer film, for example polyester film with release coat, and indirectly applied to the plastic coating by placing the transfer film on the coated fabric;

(d) color coat 14 (10–20 μm thick) on the basis of an IR-transparent binder as for example copolymers of polyethylene or polytetrafluoroethylene. Pigments less than 0.5 μm in diameter and or soluble molecular dyes give the distinct optical remission in the visual part of the electromagnetic spectrum. Primers between each layer 11 through 14 for improving the adhesive strength are not shown in FIG. 3.

In the case of a tent wall, made up of two cloth layers as shown in FIGS. 1 and 1*a*, these two layers 1 and 2 form an air gap which is open both at the bottom and at the top end. The width of this gap is maintained at a certain value which depends upon its height by strips 3 that allow free vertical air flow. The function of this gap is, that due to temperature differences between the inner and the outer tent walls the air does not transfer heat from the inner layer to the outer layer in winter or vice versa in summer by convection or conduction but that the air is constantly exchanged by free laminar flow, driven by the density difference of warmed up air keeping at least the outermost cloth layer at about the temperature of the ambient air.

One cannot generally calculate the parameters that describe the conditions for laminar air flow in an air gap in which the air is driven by the density difference between warmed-up air and cold air. Especially not in the actual case, where the air is inhomogeneously warmed-up. It is well known by experiments that air gaps 10 mm wide or less give rise to laminar air flow for all practical cases.

In some cases the air gap can be wider, giving higher value for the heat resistance for thermal conduction. Good results were experimentally found for an arrangement according to FIG. 4:

The height of the gap 20, 21 is 2 m.

At the bottom it is between 50 and 100 mm wide, at the top the width is between 15 and 50 mm approximately.

The top is covered at a distance of 200 mm by the roof 22 of the tent, to prevent rain and snow from falling inside the air gap. Generally the relation between the height and the width of the air gap is between 1:10 and 1:50.

In addition heat transfer by radiation exchange is suppressed by making the thermal emissivity of the metallized fabric about 0.1 due to the highly reflecting metal layer which is covered with a paint coat being practically pervious to the infrared portion of the spectrum from 3 to 20 μm.

The higher the reflectivity of the inner tent walls, the better is the degree of insulation and the lesser is the possibility for thermal decamouflaging and detection of the tents.

The two layer tent wall does not considerably improve the heat conservation inside the tent. Its important quality is that it lowers drastically the contrast of the tent against its surroundings both in the visible part of the spectrum and in the thermal part, particularly in the ranges of the usual sensors.

A further improvement, especially in winter, when tents must be heated, can be achieved by using a tent wall made up of three cloth layers as shown in FIG. 2. The first two layers 5 and 6 together with 7 form an open air gap as in the first case. The third layer 9 forms another air gap which is between 30 mm and 100 mm wide and is maintained by strips 8 that run perpendicular to those in the first gap 3. Furthermore this gap is completely sealed at all sides, comprising one opening for inflation. The function of the second gap is, that it forms a heat insulating air cushion. The textile strips 8 are arranged horizontally to stop the enclosed air from circulating, thus improving the thermal resistance of this gap. As in the first case, the metallization of the fabric is on the inside coated with an IR-transparent (from 3 to 20 μm) paint. Only the outside of the outermost cloth layer is covered with well known camouflage paints which are effective over a wide spectral range (UV to FIR). The roof or ceiling 4 and 10 is constructed similar to the vertical walls. Also a three layer combination for the roof may be combined with a two layer combination for the side walls, depending on the kind (style) of the tent.

As the plastic coated metallized fabric is impervious to electromagnetic radiation as well as to air and water vapor, the tent must comprise adjustable openings for taking in fresh air and for removing stale air and excess moisture.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalency of the following claims.

What is claimed is:

1. A tent arrangement providing protection against sight-optical and IR-optical search methods the improvement consisting of the tent having a multiple wall construction with the walls comprised of outer and inner layers of a plastic coated metallized cloth, metallized on both sides and covered with a coating generally pervious to the infrared portion of the spectrum ranging from substantially 3 to 20 μm, but not pervious in the visible range of the spectrum and having an air gap between said walls to enable laminer air flow therebetween said outer wall being provided on its outside surface with a camouflage paint.

2. A tent arrangement as defined in claim 1, wherein the plastic film metallized cloth has a metal layer about 20–50 NM thick and a thermal emissivity of about 0.1.

3. A tent arrangement as defined in claim 1, wherein said coating comprises a binder selected from the group consisting of copolymers of polyethylene and polytetrafluoroethylene for providing distinct optical remission in the visual part of the electromagnetic spectrum.

4. A tent arrangement as defined in claim 1, wherein said air gap is one-tenth the height of said outer cloth layer; and air space means opening outwardly in an air exhaust in the upper portion of said outer cloth layer, said exhaust having a cover.

5. A tent arrangement as defined in claim 1, including aperture means of variable cross section on the bottom portion of said outer cloth layer for continuous fresh air intake, and a variable flue aperture in the upper portion of said outer cloth layer for removal of stale air and humidity.

6. A tent arrangement as defined in claim 5, wherein a tent wall of plastic-coasted and metallized cloth is fused to the edges of said inner cloth layer for increased thermal insulation, and air filling the space between said tent wall and said inner cloth layer.

7. A tent arrangement as defined in claim 1, wherein said metallized cloth is selected from the group consisting of polyamide, polyester and glass fiber and said plastic is selected from the group consisting of soft polyvinyl chloride, polyurethane and silicone rubber, said metallized layer being vapor-deposited on a transfer film and placed on said plastic coating and selected from the group consisting of aluminum, tin and CrNi.

8. A tent arrangement as defined in claim 1, comprising further an innermost cloth layer forming a sealed air gap for forming a heat insulating air cushion, said innermost cloth layer being coated on its inside with a coating substantially pervious to the infrared portion of the spectrum of substantially 3–20 μm, and horizontal strips for reducing air circulation inside said sealed air gap.

* * * * *